US011134740B2

(12) United States Patent
Musal

(10) Patent No.: US 11,134,740 B2
(45) **Date of Patent: *Oct. 5, 2021**

(54) HELMET GOGGLE STRAP HOLDER

(71) Applicant: Bell Sports, Inc., Scotts Valley, CA (US)

(72) Inventor: Michael J. Musal, Soquel, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 259 days.

This patent is subject to a terminal disclaimer.

(21) Appl. No.: 16/386,113

(22) Filed: Apr. 16, 2019

(65) Prior Publication Data

US 2019/0239591 A1 Aug. 8, 2019

Related U.S. Application Data

(63) Continuation of application No. 15/425,100, filed on Feb. 6, 2017, now Pat. No. 10,258,099.

(51) Int. Cl.
*A42B 3/18* (2006.01)
*A42B 3/28* (2006.01)
*A63B 71/10* (2006.01)

(52) U.S. Cl.
CPC ..... *A42B 3/185* (2013.01); *A42B 3/283* (2013.01); *A63B 71/10* (2013.01)

(58) Field of Classification Search
CPC ..... A42B 3/185; A42B 3/063; A42B 3/283; A42B 71/10
See application file for complete search history.

(56) References Cited

U.S. PATENT DOCUMENTS

| | | | | |
|---|---|---|---|---|
| 3,797,040 | A * | 3/1974 | Caldwell | A42B 3/166 2/421 |
| 5,636,388 | A | 6/1997 | Hodges | |
| 5,940,890 | A | 8/1999 | Dallas et al. | |
| D622,007 | S | 8/2010 | Higgins | |
| 2003/0093853 | A1 | 5/2003 | Maloney | |
| 2012/0180203 | A1 | 7/2012 | Giroux et al. | |
| 2013/0139288 | A1 | 6/2013 | Gisquiere et al. | |

FOREIGN PATENT DOCUMENTS

| | | |
|---|---|---|
| WO | 2005070359 | 8/2005 |
| WO | 2011101663 | 8/2011 |

* cited by examiner

*Primary Examiner* — Khaled Annis
(74) *Attorney, Agent, or Firm* — Amardeep S. Grewal; Gerard M. Donovan; Reed Smith LLP

(57) ABSTRACT

A helmet and goggle strap clip combination includes a helmet body with an outer shell having an opening in a surface. The goggle strap clip includes a clip body, a resilient leg extending in a first direction with a foot at an end of the leg. The foot includes a foot body, an outer side facing away from the helmet body and an inner side facing the helmet body, a cover extends from the foot body in the first direction, a support fin extending from the foot body in a second direction, opposite the first direction. The cover overlaps the outer shell by a side edge, the support fin is positioned inside of and engaging the outer shell by a second side edge, and the clip body is in direct contact with the outer shell separate from the leg and its foot.

20 Claims, 5 Drawing Sheets

HELMET GOGGLE STRAP HOLDER

RELATED APPLICATIONS

This application is a continuation application of the U.S. Nonprovisional application Ser. No. 15/425,100, filed on Feb. 6, 2017, titled "Helmet Goggle Strap Holder," now pending, the disclosure of which being hereby incorporated entirely herein by reference.

TECHNICAL FIELD

Aspects of this document relate generally to a clip to retain a helmet goggle strap on the helmet.

BACKGROUND

A user often wears goggles to protect the eyes in addition to a protective headgear or helmet. A clip provides a convenient solution to keep the goggles on the helmet. But such a clip often requires tools or attachments to assemble the clip onto, and dissemble the clip from, the helmet, and also does not have sufficient tension to hold the goggles on the helmet.

It would be desirable to have a helmet goggle retention clip that can be assembled onto, or removed from, the helmet without any additional tools or attachments and still has sufficient tension to hold the goggles in place.

SUMMARY

According to one aspect of the disclosure, a helmet may comprise a helmet body comprising an outer shell, an energy management layer inside the outer shell, and a fit system within the energy management layer and coupled to the helmet body, the outer shell comprising at least one aperture through a rear surface of the outer shell, the at least one aperture comprising at least two side edges, and a helmet goggle strap retention clip comprising a clip body, at least one resilient leg extending from the clip body in a first direction and symmetrical about a center of the clip body, each of the at least one resilient leg comprising a foot at an end of each of the at least one resilient leg, each foot extending outward of its resilient leg in relation to the center of the clip body and comprising: a foot body, an outer side facing away from the helmet body and an inner side facing the helmet body, a cover portion extending from the foot body in the first direction, a support fin extending from the foot body in a second direction, opposite the first direction, wherein each cover portion is positioned overlapping the outer shell adjacent to a first one of the at least two side edges, each respective support fin is positioned inside of and engaging the outer shell adjacent to a second one of the at least two side edges, different from the first one, and the clip body is in direct contact with the outer shell separate from the at least one resilient leg and its foot.

Particular embodiments may comprise one or more of the following features. The clip body may comprise an anchor extending in the second direction and forming an arch together with the clip body and the at least one resilient leg, the arch extending from the anchor to the foot and the clip body directly contacting the outer shell through the anchor. The at least one aperture may be at least one air vent that extends through the outer shell and through the energy management layer of the helmet. The least one aperture may comprise two air vents that extend through the outer shell and through the energy management layer of the helmet, wherein the at least one resilient leg comprises two resilient legs symmetrically positioned about the center of the clip body, and a perimeter of each foot directly engages a perimeter surface of each air vent. The at least one aperture may be a single air vent centered on a back of the helmet. The single air vent may have a rectangular in shape. Each foot may comprise a first step between the cover portion and the foot body so that the foot body extends farther toward the inner side of the foot body than the cover portion. The helmet may be assembled by placing each foot of the goggle strap retention clip into the at least one aperture, positioning the cover portion of each foot against an outer surface of the outer shell, positioning the support fin of each foot at least partially inside of and engaging the outer shell, compressing the at least one resilient leg toward the outer shell by applying pressure on the at least one resilient leg to press the at least one resilient leg closer to the outer shell, to press each foot farther into the at least one aperture, and to press the clip body against the outer shell, and seating each foot of the goggle strap retention clip into the at least one aperture by releasing the pressure on the at least one resilient leg so that the clip body extends along the outer surface of the outer shell and retains pressure of the clip body against the outer shell.

According to another aspect of the disclosure, a helmet goggle strap retention clip may comprise a clip body and at least one resilient leg extending from the clip body in a first direction and symmetrical about a center of the clip body, each of the at least one resilient leg comprising a foot at an end of each of the at least one resilient leg, each foot comprising: a foot body, an outer side and an inner side facing opposite the outer side, a cover portion extending from the foot body in a cover portion extension direction, the cover portion extension direction comprising at least one of the first direction and a second direction adjacent to the first direction, the foot extending outward of its resilient leg in relation to the center of the clip body and further comprising a support fin extending from the foot body in a direction opposite from the first direction, wherein the clip body comprises a goggle strap anchor extending in the opposite direction from the first direction and forming an arch together with the clip body and the at least one resilient leg, the arch extending from the anchor, through the at least one resilient leg and to each foot, and wherein each foot of each resilient leg is configured to engage at least one opening in an outer shell of a helmet with the cover portion positioned to overlap a portion of the outer shell of the helmet adjacent to a first side edge of the at least one opening and with each support fin positioned inside of and engaging the outer shell adjacent to a second side edge of the at least one opening, opposite the first side edge.

Particular embodiments may comprise one or more of the following features. Each foot of each resilient leg may further comprise a first step between the cover portion and the foot body so that the foot body extends farther toward the inner side of the foot body than the cover portion does. Each foot cover portion may extend from each foot body in at least the first direction and the support fin extends in the opposite direction from the first direction. Each foot cover portion may extend from each foot body in both of the first direction and the second direction. The at least one resilient leg may comprise two resilient legs and each foot cover portion extends from each foot body in at least the first direction and the support fin extends from each foot body in a direction away from the center of the clip body. Each foot may comprise a first step between the cover portion and the foot body so that the foot body extends farther toward the inner side of the foot body than the cover portion.

According to another aspect of the disclosure, a helmet may comprise a helmet body comprising an outer shell, an energy management layer inside the outer shell, and a fit system within the energy management layer and coupled to the helmet body, the outer shell comprising at least one opening in a rear surface of the outer shell, the at least one opening comprising at least two side edges, and a helmet goggle strap retention clip comprising a clip body comprising an anchor in direct contact with the outer shell, at least one resilient leg extending from the clip body in a first direction and symmetrical about a center of the clip body, each of the at least one resilient leg comprising a foot at an end of the at least one resilient leg, each foot extending outward of its resilient leg in relation to the center of the clip body and comprising: a foot body, an outer side facing away from the helmet body and an inner side facing the helmet body, a cover portion extending from the foot body in the first direction, a support fin extending from the foot body in a second direction, different from the first direction, wherein each cover portion is positioned overlapping the outer shell adjacent to a first one of the at least two side edges, each respective support fin is positioned inside of and engaging the outer shell adjacent to a second one of the at least two side edges, different from the first one, and the helmet goggle retention clip is in a state of tension between the anchor contacting the outer shell and the feet of the at least one resilient leg engaging the at least one opening.

Particular embodiments may comprise one or more of the following features. The at least one opening may be at least one air vent that extends through the outer shell and through the energy management layer of the helmet. The at least one resilient leg may comprise at least two resilient legs, the least one opening comprises two air vents that extend through the outer shell and through the energy management layer of the helmet, and a perimeter of each foot directly engages a perimeter surface of each air vent. The at least one opening may be a single air vent centered on a back of the helmet. The single air vent may be rectangular in shape. Each foot may comprise a first step between the cover portion and the foot body so that the foot body extends farther toward the inner side of the foot body than the cover portion.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1:
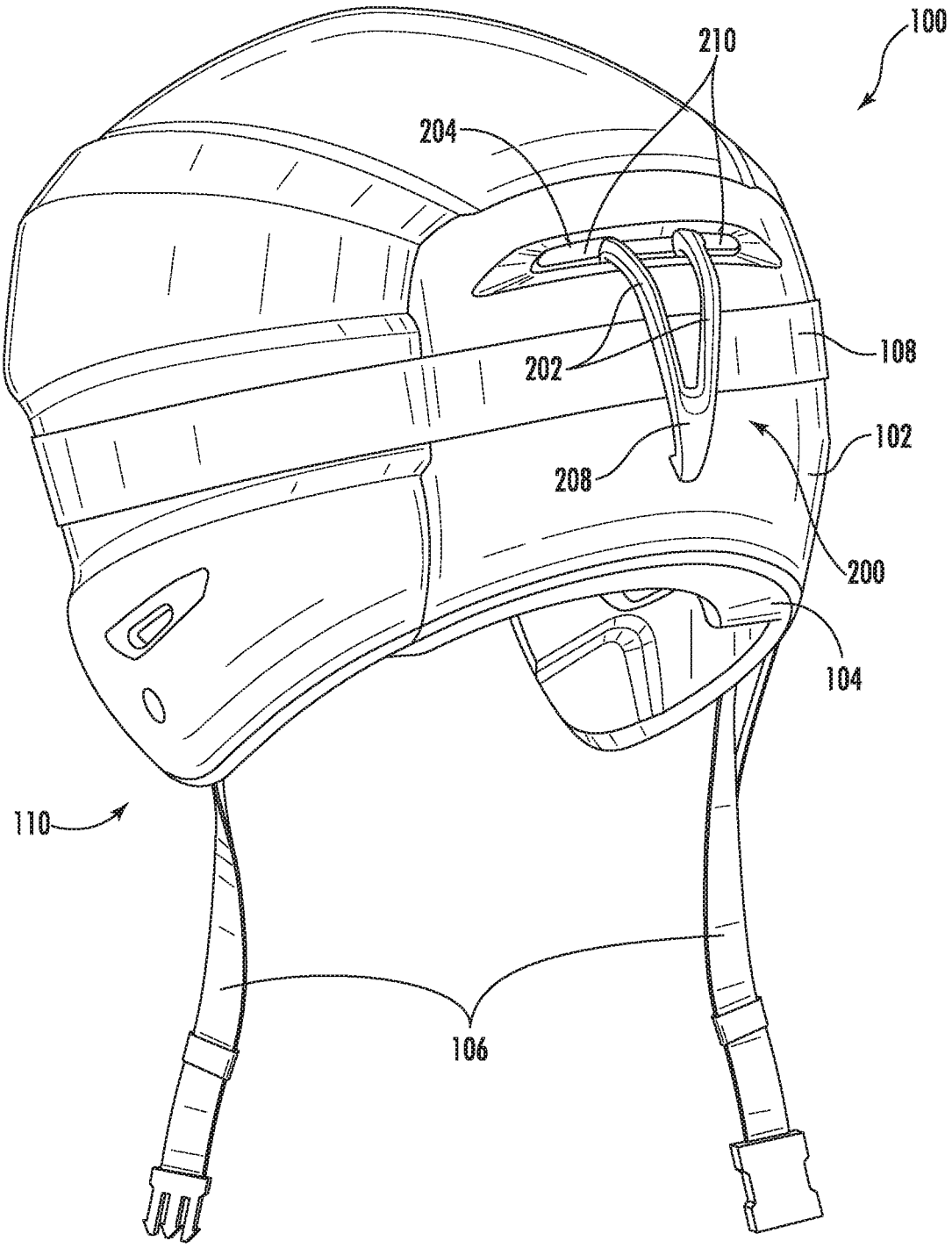
FIG. 1 is a rear perspective view of a helmet assembled with a helmet goggle strap retention clip.

Protective head gear and helmets have been used in a wide variety of applications and across a number of industries including recreation, sports, athletics, construction, mining, military defense, and others, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a user to releasably wear their helmet, and to ensure the helmet remains on the user's head during an impact. Helmet goggles may be used for additional protection of the eyes. To help the helmet goggles to stay on the helmet, a goggle clip may be used. Such a clip typically requires a tool to couple the clip to the helmet with screws, and leaves visible screw holes in the back of the helmet when the clip is not used.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example" or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Accordingly, this disclosure discloses protective headgear and a helmet goggle strap retention clip, as well as a system and method for providing a helmet or protective headgear, that, although it's primary use may be for snow skiers, may be used for a cyclist, football player, hockey player, baseball player, lacrosse player, polo player, climber, auto racer, motorcycle rider, motocross racer, snowboarder or other snow or water athlete, sky diver or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Helmets function to provide protection while minimizing interference with an activity. The shape of a helmet may be adapted to provide both protection and comfort (e.g. ventilation, size, etc.). Some helmets are made up of two or more bodies of energy-absorbing material to form shapes that would be difficult, if not impossible, to achieve in a single molded piece.

Various implementations and embodiments of protective helmets according to this disclosure comprise a protective shell. The protective shell can be made of an energy absorbing material, such as expanded polystyrene (EPS), expanded polyurethane (EPU), expanded polyolefin (EPO), expanded polypropylene (EPP), or other suitable material. The energy absorbing material can be part of a hard-shell helmet such as a skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material can comprise one or more layers of EPP and provide more flexibility than available with conventional in-molded helmets. Alternatively, the energy absorbing material can be part of an in-molded helmet such as bicycle helmet or cycling helmet. As an energy-absorbing layer in an in-molded helmet, the protective shell can comprise rigid materials such as EPS and EPU. An outer shell layer, such as a layer of stamped polyethylene terephthalate (PET) or a polycarbonate shell, can be included on an outer surface of the protective shell of the helmet and be bonded directly to the expanding foam (e.g. EPS as it is expanding such that the foam is molded in the shell).

In places where the description above refers to particular implementations of protective helmets it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein.

Contemplated as part of this disclosure is a helmet goggle strap retention clip that can be placed on a helmet without any additional tools or attachments and, in mean time, provide sufficient force to hold the helmet goggle strap on the helmet.

Referring now to FIG. 1, a non-limiting embodiment of a helmet implemented according to the present disclosure is depicted. A helmet 100 may comprise a helmet body 110 and a helmet goggle strap retention clip 200. The helmet body 110 may comprise an outer shell 102, an energy management layer inside the outer shell 104, and a fit system 106 within the energy management layer and coupled to the helmet body. The clip 200 may comprise a clip body 208, and two resilient legs 202. Each legs 202 may further comprise a foot 210. The clip 200 holds a helmet goggle strap 108 on the helmet 100. Although a particular embodiment of a helmet is illustrated in the various figures, this disclosure is not limited in its application to a particular helmet type or style, or to the various features, helmet straps, fit system types or shape or type of helmet. The embodiments disclosed and described for a helmet goggle strap clip is applicable to any helmet where it is desirable to attach a goggle strap.

Figure 3A:
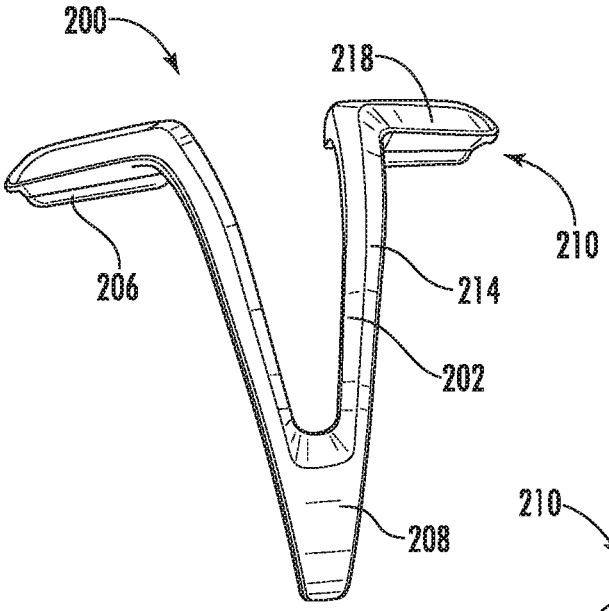
FIG. 3A is a front view of a helmet goggle strap retention clip.

Although particular embodiments illustrate two separate, resilient legs 202 as support for the clip in coupling the clip to the helmet 100, it should be clear from this discussion that one or more resilient legs 202 are sufficient to provide the coupling foot 210 and support needed for the clip to function. The clip 200 may extend with the clip body 208 continuing as one piece all the way to a single foot 210 centered on the clip rather than split into two legs 202 and feet 210. The use of two separate feet and legs in the particular embodiment of FIG. 3A is for stylistic convenience and is not a requirement of the disclosure. Even just one of the one or more legs and corresponding feet illustrated in the Figures would provide the support needed for the clip to hold a goggle strap. Furthermore, in a particular embodiment, it is specifically contemplated that an embodiment may comprise only a single resilient leg 202 with a single foot 210 formed at an end of the single leg with a cover portion 204 that extends over a portion of the helmet opening, and support fin 206 that extends inward of the opening in the outer shell will be used.

Figure 2:
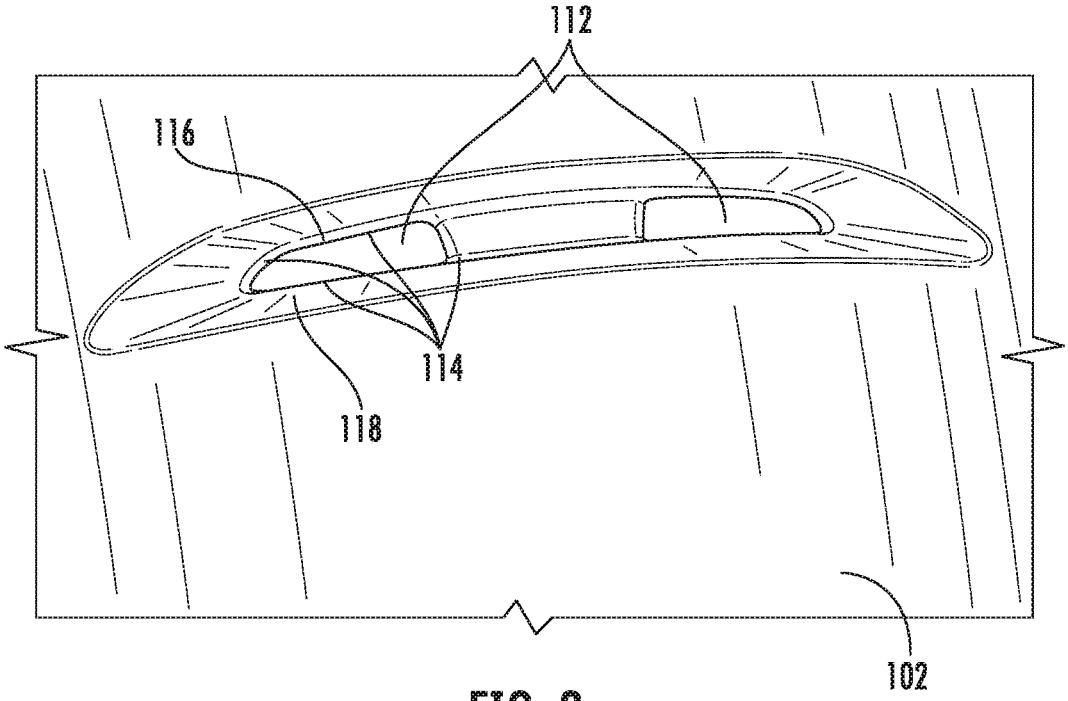
FIG. 2 is a close-up view of the helmet of FIG. 1.

Referring now to FIG. 2, a close-up view of the rear surface of the helmet of FIG. 1 is provided. The outer shell 102 further comprises at least one aperture 112 through a rear surface of the outer shell, the sides 114 of the at least one aperture 112 defining a perimeter of the aperture with a specific upper 116 and lower 118 edge of the aperture. The aperture 112 or opening may comprise an aperture through the outer shell to the inside of the helmet, like an air vent, or may comprise simply a recess in the outer shell or an aperture that extends through the outer shell but not all the way through to the inside, head area, of the helmet.

Figure 3B:
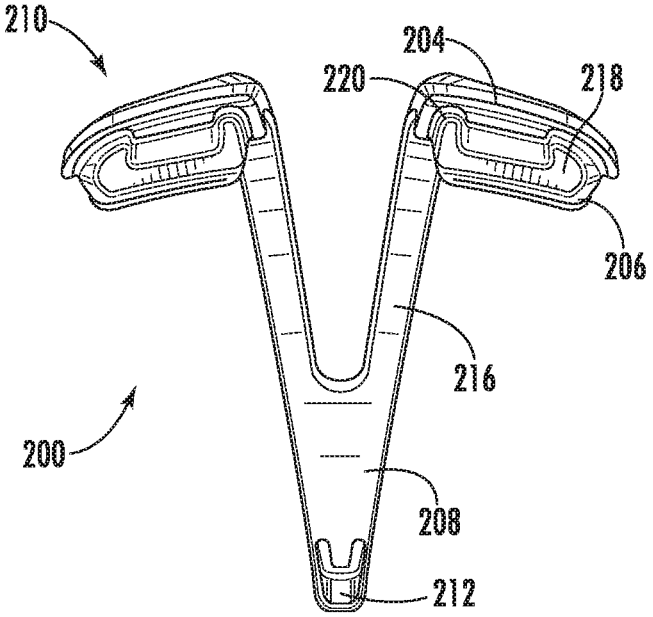
FIG. 3B is a rear view of the helmet goggle strap retention clip of FIG. 3A.
Figure 3C:
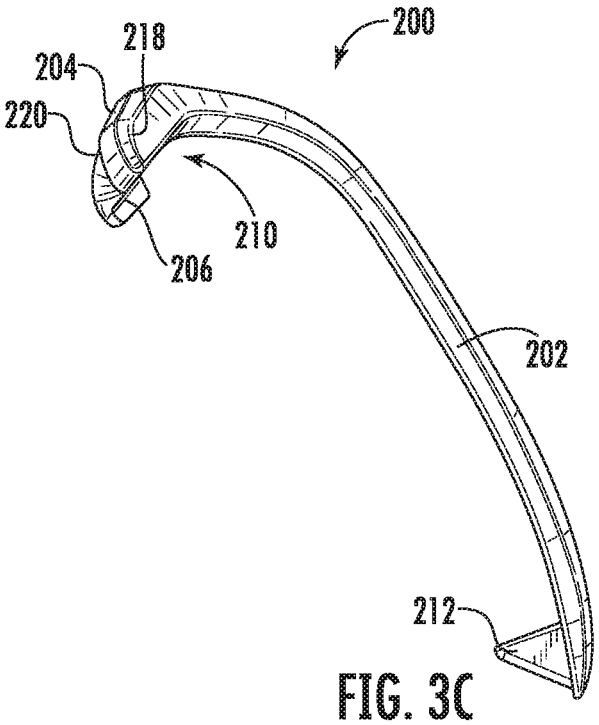
FIG. 3C is a left perspective view of the helmet goggle strap retention clip of FIG. 3A.

Referring now to FIGS. 3A-3C, front, rear, and left side views of a helmet goggle strap retention clip implemented according to an embodiment of this disclosure are provided. The clip 200 comprises a clip body 208 and two resilient legs 202, each of which further comprises a foot 210. The legs may extend from the clip body 208 in a first direction and be symmetrical about the center of the clip body 208. Each foot 210 may extend outward of its leg in relation to the center of the clip body 208 and comprise a foot body 218, an outer side 214, and an inner side 216. When the clip is placed on the helmet and the feet seat into the apertures, the outside side faces away from the outer shell and the inner side faces toward the outer shell. Each foot 210 may further comprise a cover portion 204 and a support fin 206. The cover portion 204 extends in the first direction from the foot body 218 and the support fin 206 extends from the foot body 218 in the opposite direction from the first direction. Each foot 210 may further comprise a first step 220 between the cover portion 204 and the foot body 218. At the first step 220, the foot body 218 extends further toward the inner side 216 of the clip 200 than the cover portion 204. To help in the removal of the clip, a coin, a key, a screwdriver blade, or other hard, flat object may be placed behind the cover portion at the first step to push the clip out of the helmet aperture using the hard object. At other times, a fingernail may be used to aid in extraction.

Figure 4A:
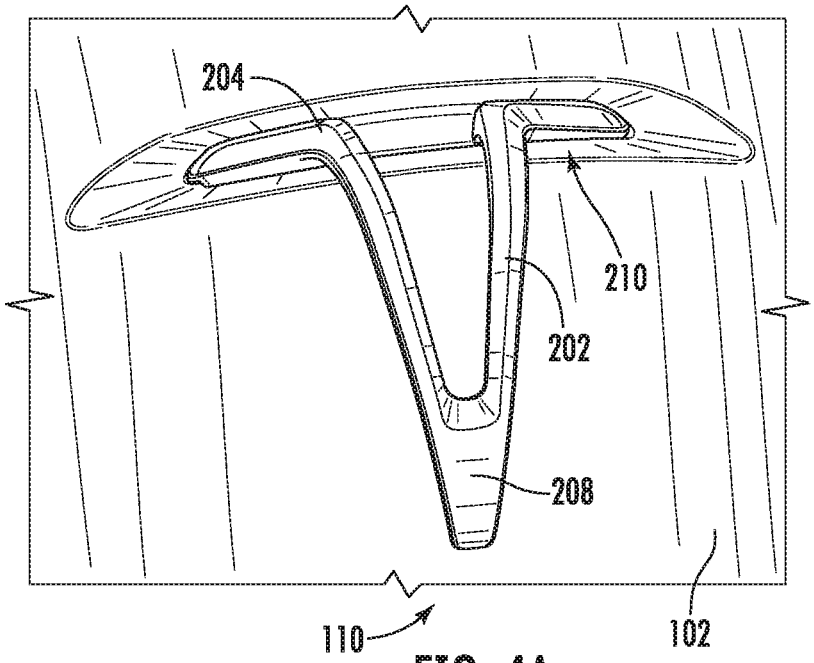
FIG. 4A is the close-up front view of the helmet from FIG. 2 assembled with the helmet goggle strap retention clip of FIG. 3A.
Figure 4B:
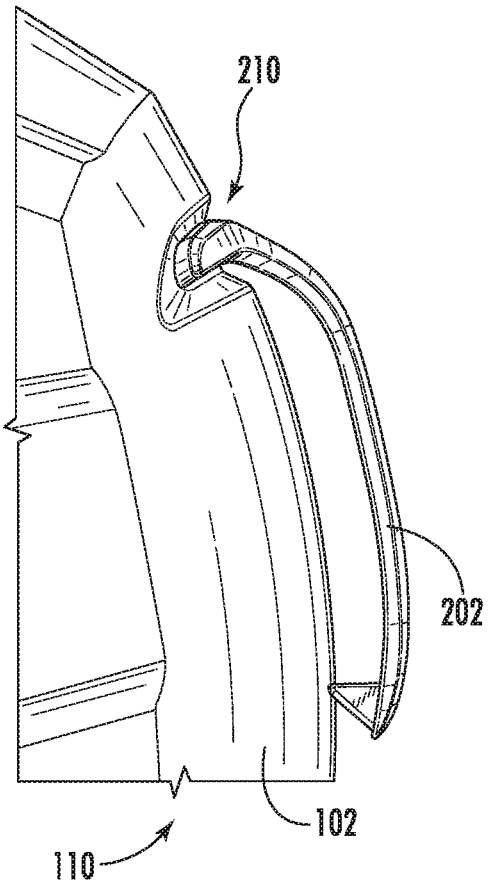
FIG. 4B is a close-up left side view of the helmet assembled with a helmet goggle strap retention clip of FIG. 4A.
Figure 4C:
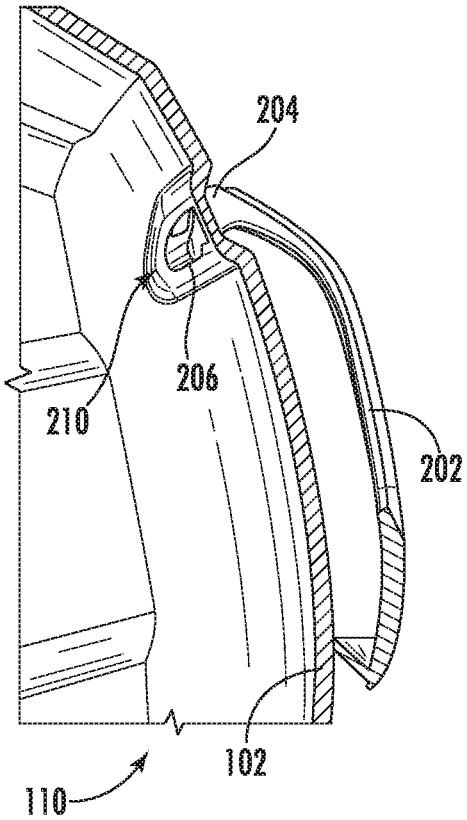
FIG. 4C is a close-up cross-sectional view of the helmet assembled with a helmet goggle strap retention clip from FIG. 4A taken at the center of the retention clip.

Referring now to FIGS. 4A-4C, a close-up rear view, a close-up left side view, and a close-up cross-sectional left side view of a non-limiting embodiment are provided. The aperture 112 on the outer shell 102 may comprise at least two side edges 114 (FIG. 2). Each of the cover portion 204 on each foot 210 is positioned overlapping a portion of the outer shell 102 adjacent to the first, upper, side edge 116, and each respective support fin 206 is positioned inside of and engaging the outer shell adjacent to the second, lower, side edge 118. The support fin 206 engages the outer shell by contacting a side edge 114 of the outer shell, and in some embodiments, the support fin 206 contacts an inner surface of the outer shell, though this is not required for engagement. The clip may further comprise an anchor 212 extending from the clip body 208 toward the outer shell and directly contacts the outer shell. The anchor 212 may form an arch (FIGS. 4B, 4C) with the clip body 208 and the legs 202, where the arch extends from the anchor 212 to the feet 210. When pressure is applied on the resilient legs 202 in a direction toward the outer shell, the legs 202 flex and, as a result, the feet 210 pivot so that the support fins 206 are fitted through the aperture 112 (FIG. 2), and extend through the outer shell 102. A portion of the force stored in the resilient legs 202 by the pressure applied against them is retained in the clip when the pressure is released through the feet 210 engaging the sides of the aperture 112 in the outer shell 102, counter-balanced by the clip body 208 pressing against the outer shell 102 to retain the clip in a state of tension. To dissemble the clip from the helmet, pressure can be applied on the legs so that the resilient legs 202 flex and cause the feet 210 to pivot so that they can be disengaged from the outer shell, a tool may be used to pry and disengage the feet from the outer shell, or a strong force may be applied to pull the feet away and disengage them from the outer shell.

In some embodiments, the apertures may be the air vents that extend through the outer shell and through the energy management layer of the helmet. In some embodiments, each cover portion of each foot extends in the first direction, one of the directions adjacent to the first direction, or any combination of these directions and may contact multiple sides of the at least one aperture in the outer shell. In some embodiments, the apertures may be two air vents that extend through the outer shell and through the energy management layer of the helmet and each foot's perimeter conforms to each air vent's perimeter. In some embodiments, each support fin may also extend from each foot body in the direction away from the center of the clip body. In some embodiments, the aperture may be a single air vent centered on the back of the helmet. In some embodiments, such a single air vent may be rectangular in shape.

In some embodiments, the aperture in the helmet is only an opening that extends through the outer shell or shells and not all the way to the internal of the helmet. In such cases, the aperture need not be a vent opening. Additionally, the shape of the opening, whether a vent or not, is not limited to any particular shape and may be square, rectangular, round, elliptical, semi-circular or any other shape determined useful for receiving a support foot of a clip.

Figure 5:
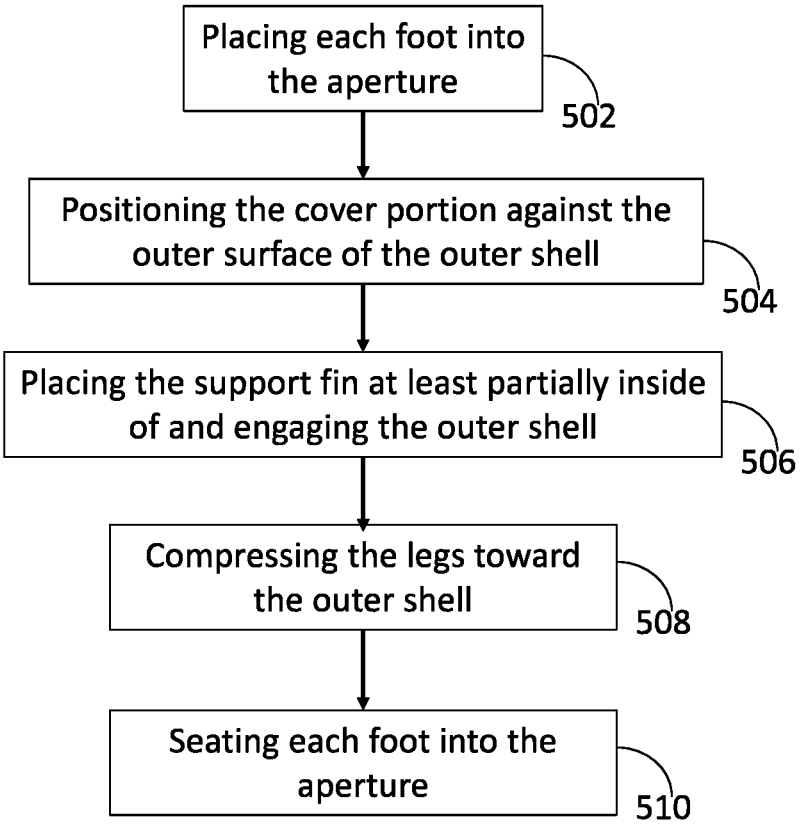
FIG. 5 is a flow chart of a method of assembling a helmet with a goggle strap retention clip.

FIG. 5 is a flow chart of an exemplary method of assembling a helmet 100 with a helmet goggle strap retention clip 200. Each foot of the clip is placed into the at least one aperture (502). Each cover portion of each foot is positioned against the outer surface of the outer shell of the helmet (504). Each support fin of each foot is positioned at least partially inside of and engaging the outer shell (506). The two legs are compressed toward the outer shell by applying pressure on the legs to press the legs closer to the outer shell, to press each foot farther into the aperture, and to press the clip body against the outer shell (508). Each foot is seated into the aperture by releasing the pressure on the legs so that the clip body extends along the outer surface of the outer shell and retains pressure of the clip body against the outer shell (510).

This disclosure, its aspects and implementations, are not limited to the specific components or assembly procedures disclosed herein. Many additional components and assembly procedures known in the art consistent with the intended helmet, helmet goggle strap retention clip, and methods of assembling a helmet goggle strap retention clip with a helmet will become apparent for use with implementations of the apparatus and methods from this disclosure. In places where the description above refers to particular implementations of a helmet, a helmet goggle strap retention clip, and methods of assembling a helmet goggle strap clip with a helmet, it should be readily apparent that a number of modifications may be made without departing from the spirit thereof and that these implementations may be applied to other helmets, other helmet goggle strap retention clips, and other methods of assembling a helmet goggle strap clip with a helmet. Accordingly, for example, although particular helmets, helmet goggle strap retention clips, and methods of assembling a helmet goggle strap clip with a helmet are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet, helmet goggle strap retention clips, and methods of assembling a helmet goggle strap clip with a helmet may be used.

The invention claimed is:

1. A helmet comprising:

a helmet body comprising an outer shell and a fit system coupled to the helmet body, the outer shell comprising at least one aperture through a rear surface of the outer shell, the at least one aperture comprising at least two side edges; and a helmet goggle strap retention clip comprising:

a clip body; and at least one resilient leg extending from the clip body in a first direction in relation to a center of the clip body and a foot at an end of each of the at least one resilient leg, each foot extending from its resilient leg in relation to the center of the clip body and comprising: a foot body, a first side facing away from the helmet body and a second side facing the helmet body, a cover portion extending from the foot body in the first direction, a support fin extending from the foot body in a second direction, opposite the first direction;

wherein each cover portion is positioned overlapping the outer shell adjacent to a first one of the at least two side edges, each respective support fin is positioned inside of and engaging the outer shell adjacent to a second one of the at least two side edges, different from the first one, and the clip body is in direct contact with the outer shell separate from the at least one resilient leg and its foot.

2. The helmet of claim 1, wherein the clip body further comprises an anchor extending in the second direction and forming an arch together with the clip body and the at least one resilient leg, the arch extending from the anchor to the foot and the clip body directly contacting the outer shell through the anchor.

3. The helmet of claim 2, wherein the at least one aperture is at least one air vent that extends through the outer shell and through an energy management layer of the helmet positioned within the outer shell.

4. The helmet of claim 2, wherein the at least one aperture is a single air vent centered on a back of the helmet.

5. The helmet of claim 4, wherein the single air vent is rectangular in shape.

6. The helmet of claim 1, wherein the least one aperture comprises two air vents that extend through the outer shell and through an energy management layer of the helmet positioned within the outer shell, wherein the at least one resilient leg comprises two resilient legs symmetrically positioned about the center of the clip body, and a perimeter of each foot directly engages a perimeter surface of each air vent.

7. The helmet of claim 1, wherein each foot of the at least one resilient leg comprises a first step between the cover portion and the foot body so that the foot body extends farther toward the inner side of the foot body than the cover portion.

8. The helmet of claim 1, wherein the at least one resilient leg comprises two resilient legs and each foot cover portion extends from each foot body in at least the first direction and the support fin extends from each foot body in a direction away from the center of the clip body.

9. A helmet goggle strap retention clip comprising:

a clip body; and at least one resilient leg extending from the clip body in a first direction and symmetrical about a center of the clip body, each of the at least one resilient leg comprising a foot at an end of each of the at least one resilient leg, each foot comprising: a foot body, a first side and a second side facing opposite the first side, a cover portion extending from the foot body in a cover portion extension direction, the cover portion extension direction comprising at least one of the first direction and a second direction adjacent to the first direction, the foot extending from its resilient leg in relation to the center of the clip body and further comprising a support tin extending from the foot body in a direction opposite from the first direction;

wherein the clip body comprises a goggle strap anchor extending in the opposite direction from the first direction and forming an arch together with the clip body and the at least one resilient leg, the arch extending from the anchor, through the at least one resilient leg and to the foot at the end of each of the at least one resilient leg; and wherein the foot at the end of each of the at least one resilient leg is configured to engage at least one opening in an outer shell of a helmet with the cover portion positioned to overlap a portion of the outer shell of the helmet adjacent to a first side edge of the at least one opening and with each support fin positioned inside of and engaging the outer shell adjacent to a second side edge of the at least one opening, opposite the first side edge.

10. The helmet goggle strap retention clip of claim 9, wherein the foot at the end of each of the at least one resilient leg further comprises a first step between the cover portion and the foot body so that the foot body extends farther toward the second side of the foot body than the cover portion does.

11. The helmet goggle retention strap of claim 9, wherein the cover portion extends from the foot body of the foot at the end of each of the at least one resilient leg in at least the first direction and the support fin extends in the opposite direction from the first direction.

12. The helmet goggle retention strap of claim 11, wherein the cover portion extends from the foot body of the foot at the end of each of the at least one resilient leg in both of the first direction and the second direction.

13. The helmet goggle retention strap of claim 9, wherein the at least one resilient leg comprises two resilient legs and each foot cover portion extends from each foot body in at least the first direction and the support fin extends from each foot body in a direction away from the center of the clip body.

14. The helmet of claim 9, wherein the foot at the end of each of the at least one resilient leg comprises a first step between the cover portion and the foot body so that the foot body extends farther toward the second side of the foot body than the cover portion.

15. A helmet comprising:

a helmet body comprising an outer shell and a fit system coupled to the helmet body, the outer shell comprising at least one opening in an outer surface of the outer shell, the at least one opening comprising at least two side edges; and a helmet goggle strap retention clip comprising:

a clip body comprising an anchor in direct contact with the outer shell; and at least one resilient leg extending from the clip body in a first direction, each of the at least one resilient leg comprising a foot at an end of the at least one resilient leg, each foot extending from its resilient leg in relation to a center of the clip body and comprising: a foot body, a first side facing away from the helmet body and a second side facing the helmet body, a cover portion extending from the foot body in the first direction, a support fin extending from the foot body in a second direction, different from the first direction;

wherein each cover portion is positioned overlapping the outer shell adjacent to a first one of the at least two side edges, each respective support fin is positioned inside of and engaging the outer shell adjacent to a second one of the at least two side edges, different from the first one, and the helmet goggle retention clip is in a state of tension between the anchor contacting the outer shell and the support fin engaging the at least one opening.

16. The helmet of claim 15, wherein the at least one opening is at least one air vent that extends through the outer shell and through an energy management layer of the helmet that is positioned within the outer shell.

17. The helmet of claim 15, wherein the at least one resilient leg comprises at least two resilient legs, the least one opening comprises two air vents that extend through the outer shell and through an energy management layer of the helmet that is positioned within the outer shell, and a perimeter of each foot directly engages a perimeter surface of each air vent.

18. The helmet of claim 17, wherein the single air vent is rectangular in shape.

19. The helmet of claim 15, wherein the at least one opening is a single air vent centered on a back of the helmet.

20. The helmet of claim 15, wherein each foot comprises a first step between the cover portion and the foot body so that the foot body extends farther toward the second side of the foot body than the cover portion.

* * * * *